United States Patent [19]

Kolb et al.

[11] 4,392,118

[45] Jul. 5, 1983

[54] THERMAL OVERLOAD RELAY HAVING A N.O. OR N.C. CONTACT UNIT SELECTIVELY ADDABLE IN THE FIELD

[75] Inventors: Arthur F. Kolb; Arthur J. Franklin, both of Bowling Green; Toby I. Miller, Rockfield, all of Ky.

[73] Assignee: Eaton Corporation, Cleveland, Ohio

[21] Appl. No.: 354,121

[22] Filed: Mar. 2, 1982

[51] Int. Cl.[3] ..... H01H 71/20; H01H 73/22

[52] U.S. Cl. ..... 337/154; 335/198; 337/151

[58] Field of Search ..... 337/154, 151, 155, 146; 335/198

[56] References Cited

U.S. PATENT DOCUMENTS 3,478,292 11/1969 Carter et al. ..... 337/151

3,890,585 6/1975 Hartop ..... 335/198

OTHER PUBLICATIONS

Square D Co. Service Bulletin 277AS, Classes 8502 and 8536, Size O-AC, Magnetic Contactors and Starters Type SB, Series A or Series B, Jul. 1975, pp. 1-2.

*Primary Examiner*—Harold Broome

*Attorney, Agent, or Firm*—C. H. Grace; W. A. Autio

[57] ABSTRACT

A thermal overload relay for a three-phase power supply circuit having an auxiliary normally open (N.O.) or a normally closed (N.C.) contact unit (FIG. 5, FIG. 6) selectively addable in the field. The relay is provided with the standard normally closed contact by way of a subassembly (20) that is installed by the manufacturer for circuit protective purposes and a slot (**12*p*) and securing means (12*n*, 77) alongside this subassembly for receiving an auxiliary contact unit (57) that can be inserted and secured by a screw (77) in the field. A contact operating lever (54) is constructed so that it will actuate the auxiliary contact unit (57) at the end of the trip stroke thereby affording redistribution or retiming of the spring forces that will enhance the tripping function because less initial spring force is required at the beginning of the trip stroke. The N.O. and N.C. auxiliary contact units (57) are assembled from common parts plus a selected one of two interchangeable contact bias springs (74, 78**) and are constructed so as to have wiping action to insure low voltage level reliability.

10 Claims, 8 Drawing Figures

THERMAL OVERLOAD RELAY HAVING A N.O. OR N.C. CONTACT UNIT SELECTIVELY ADDABLE IN THE FIELD

BACKGROUND OF THE INVENTION

Thermal overload relays having a normally open contact in addition to the standard normally closed contact have been known heretofore. The standard normally closed contact is of course used for the primary circuit control function of initiating a circuit interrupting action when an overload occurs in the system. The auxiliary normally open contact has been used for alarm purposes. For example, U. F. Carter et al. U.S. Pat. No. 3,478,292, dated Nov. 11, 1969, and owned by the assignee of this invention, shows a thermal overload relay having a protector normally closed contact and an auxiliary normally open contact that is used for indicator purposes. As shown in FIG. 9 of this patent, these contacts form part of a unitary switch and are mounted on a common insulating member. When this thermal overload relay is assembled, a contact operating member biases the protector contact closed so that it will be normally closed as shown in FIG. 7 of this patent and at the same time biases the indicator contact open. As a result, when the thermal overload relay trips, the protector contact opens to initiate a circuit interrupting function and the indicator contact closes to initiate an indication. While a thermal overload relay of this type has been useful for its intended purpose, it has been found desirable to provide a thermal overload relay that has not only the standard normally closed contact for primary circuit control function that is installed by the manufacturer, but additionally has provision for installation in the field of an auxiliary contact that may be either normally open for alarm purposes or normally closed for monitoring purposes and which may be changed in the field from one to another without disassembling the thermal overload relay.

SUMMARY OF THE INVENTION

An object of the invention is to provide an improved overload relay.

A more specific object of the invention is to provide an overload relay with an auxiliary contact unit that may be selectively normally open or normally closed and which can be readily added or changed in the field without disassembling the overload relay.

Another specific object of the invention is to provide an overload relay with an improved contact operating lever that affords improved distribution of trip forces in that it actuates an auxiliary contact at the end of its trip stroke.

Another object of the invention is to provide an improved auxiliary contact unit which may be assembled as either a normally closed contact or a normally open contact by the substitution of only one part.

A more specific object of the invention is to provide such auxiliary contact unit with improved normally open contacts or normally closed contacts having wiping action.

Another specific object of the invention is to provide a factory-assembled thermal overload relay with an improved self-enclosed auxiliary contact unit that may be added in the field without any disassembly of the thermal overload relay.

A further specific object of the invention is to provide an overload relay with an improved auxiliary contact unit that is sealed in a self-enclosing housing and that can be readily added or exchanged in the field.

Other objects and advantages of the invention will hereinafter appear.

DESCRIPTION OF THE PREFERRED EMBODIMENT

Figure 1:
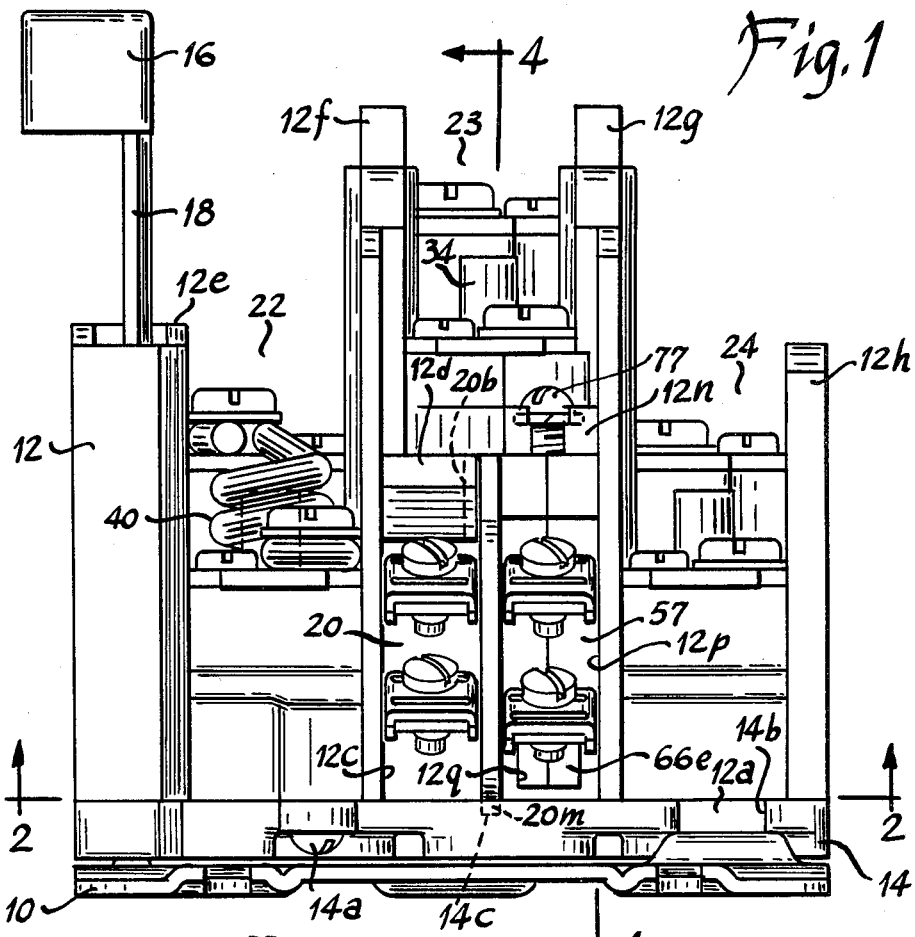
FIG. 1 is a front elevational view of a thermal overload relay for a three phase system showing only one of the heater coils mounted thereon.
Figure 2:
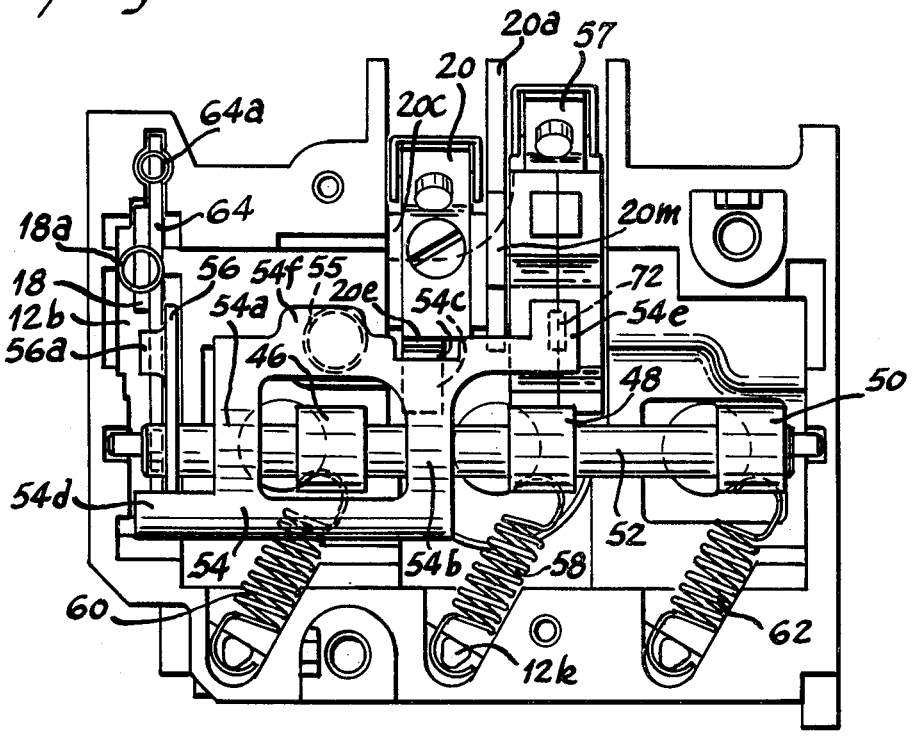
FIG. 2 is a cross-sectional view taken substantially along line 2—2 of FIG. 1 to show the standard normally closed contact, the auxiliary contact unit, the contact operating lever and the three trip levers and their associated bias springs.
Figure 3:
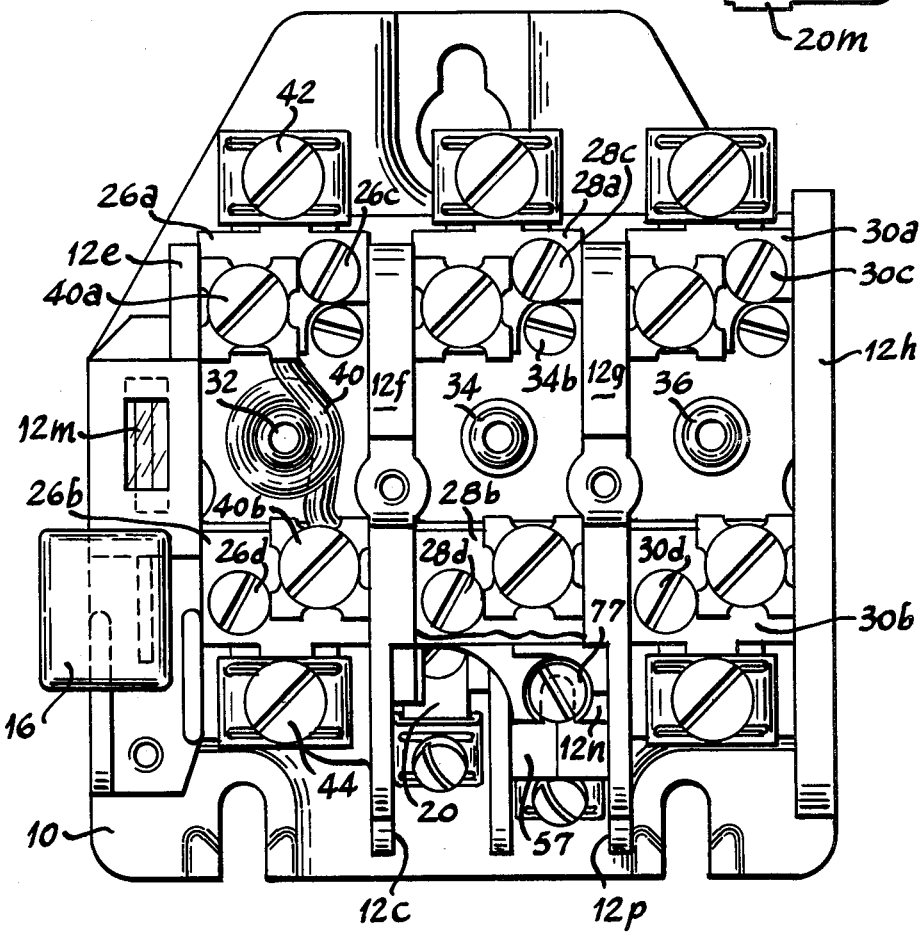
FIG. 3 is a top plan view of the thermal overload relay of FIGS. 1 and 2 showing the standard normally closed contact, the auxiliary contact unit, the three thermal elements and a heater coil mounted on one of the thermal elements.

Referring to FIGS. 1 to 3, there is shown a thermal overload relay constructed in accordance with the invention. This relay is provided with a mounting plate 10 of steel or the like, a unitary insulating housing 12 to which plate 10 is attached and an insulating bottom cover or base 14 that is between the mounting plate and the housing. Base 14 is attached by a pair of screws to the housing such as screw **14*a* shown in FIG. 1. Mounting plate 10 is also attached by a pair of screws to the housing at lugs of the housing such as 12*a* shown in FIG. 1 that extend through notches 14*b* of the base. The overload relay has a reset button 16 mounted on the upper end of a substantially flat reset lever 18 which is reciprocally movable in a cavity 12*b* formed in housing 12 as shown in FIGS. 1 and 2**.

Figure 8:
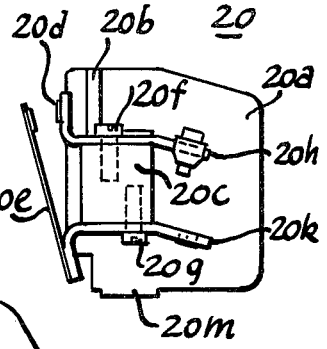
FIG. 8 is a left-side elevational view of the standard normally closed contact subassembly that is also shown in the thermal overload relay of FIGS. 1, 2 and 3.

A standard normally closed contact subassembly 20 which is best shown in detail in FIG. 8 is mounted in housing 12 between the later and base 14 which holds it in place. Swith subassembly 20 comprises an integral switch mounting and insulating member having a substantially flat mounting and barrier portion **20*a* having a vertical ridge 20*b* and a substantially cubical boss 20*c* formed on one side of the flat mounting and barrier portion. While the contact of this contact subassembly is shown normally open it will be apparent that it will be normally closed when this subassembly is mounted in the thermal overload relay. Stationary contact 20*d* and movable spring contactor 20*e* are mounted on the top and bottom sides of boss 20*c*. Screws 20*f* and 20*g* extend through clearance openings in terminal plates 20*h* and 20*k*** and are threaded into the boss to secure the contacts to the mounting and insulating plate. These contacts 20*d* and 20*e* being connected to the respective terminal plates.

Housing 12 is provided with a front opening 12*c* into which contact subassembly 20 is insertable when base 14 is removed from the housing. As shown in FIGS. 1 and 2, the forward upper part of barrier portion 20*a* and ridge 20*b* interfit in a notch behind tab 12*d* in the housing and a lower projection 20*m* on portion 20*a* extends into a complemental recess 14*c* formed in base 14 to hold the switch unit in place as shown by dotted lines in FIG. 1.

Three open stepped recesses 22, 23 and 24 are formed in top of housing 12. Intermediate partition portions 12*e*, 12*f*, 12*g* and 12*h*, provide electrical barriers between the recesses. As shown in FIG. 3, three pairs of combination wire terminal and overload mounting plates 26*a* and 26*b*, 28*a* and 28*b*, 30*a* and 30*b* are secured in place in the three recesses by pairs of screws 26*c* and 26*d*, 28*c* and 28*d*, and 30*c* and 30*d* which are threaded into blind holes in the housing. One set of such plates located at the rear of each recess is mounted at a higher level than the set at the front. The recess between partition portions 12*f* and 12*g* is at a higher elevation to provide increased electrical and heat clearance from the recesses at either side thereof and also to provide clearance for mounting standard contact subassembly 20 and the auxiliary contact unit hereinafter described therebelow.

Figure 4:
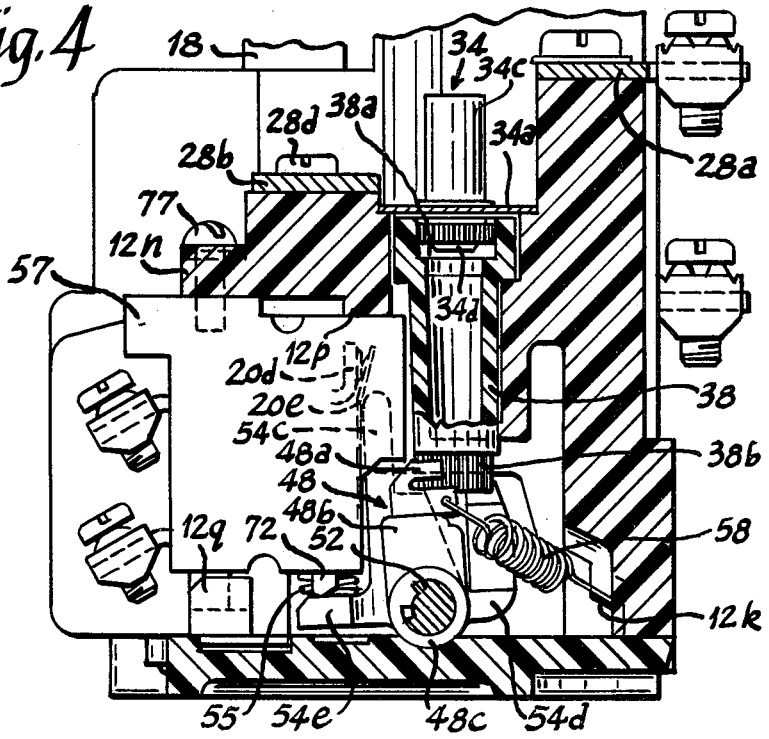
FIG. 4 is a cross-sectional view taken substantially along line 4—4 of FIG. 1 to show the auxiliary contact unit, the slot in the overload relay for receiving the auxiliary contact unit, the central thermal element and its associated trip lever and bias spring.

Eutectic thermal elements 32, 34 and 36 are alike, except that thermal element 34, which is in the center is provided with an adapter 38 extending downwardly therefrom because it is mounted higher than the other two. These thermal elements are like those described in detail in connection with FIGS. 10 and 11 of the aforementioned U. F. Carter U.S. Pat. No. 3,478,292. As shown in FIGS. 3 and 4, each of these thermal elements such as thermal element 34, for example, is provided with a mounting plate 34*a* whereby it is attached with a screw 34*b* to the housing. The eutectic thermal portion 34*c* is above the plate as shown in FIG. 4 and a ratchet wheel 34*d* extends below the plate. The ratchet wheels are normally held against rotation by the eutectic alloy solder material in the upper portion of the thermal element which adheres between adjacent surfaces and under excessive heat, melts sufficiently to allow the ratchet wheel to turn as hereinafter described.

As shown in FIGS. 1 and 3, in the left-hand recess 22, as helical heater coil 40 is positioned around the outer insulating sleeve of thermal element 32 with its ends secured by screws 40*a* and 40*b* to upper and lower terminal plates 26*a* and 26*b*. Terminal plates 26*a* and 26*b* have outwardly projecting tabs to which are secured wire retaining lugs 42 and 44. The other two pairs of terminal plates have similar wire lugs. While only one heater coil 40 has been shown in FIGS. 1 and 3 for illustrative purposes, in actual practice both of the other recesses, 23 and 24 and the thermal elements therein would also be fitted with heater coils, the same having been omitted to simplify the drawings.

When the wire lugs of the respective pairs thereof are connected in series in the three branches of a three phase system to be protected, the heater coils will be subjected to the load current. Under overload current conditions, the current flowing in a heater coil associated with an overloaded branch will cause the solder film to melt in the thermal element and thus release the associated ratchet wheel for rotation as will hereinafter be more fully described.

The ratchet wheels of the thermal elements in the two outside recesses are engaged directly by the pawls of trip levers 46 and 50 respectively, which are mounted for a limited degree of rotation on a drive shaft 52 as shown in FIG. 2. The ratchet wheel of the thermal element in the middle recess non-rotatably engages a coupling member 38 shown in FIG. 4 within a recess 38*a* formed in the upper end of the latter. This coupling member is hollow throughout the major portion of its length from the top down and has a ratchet wheel portion 38*b* formed at its lower end which is similar to and lies in a common plane with the ratchet wheel of thermal elements 32 and 36. Ratchet wheel portion 38*b* is engaged by pawl 48*a* of trip lever 48 as shown in FIG. 4, this trip lever 48 being also mounted on shaft 52.

A switch contact operating lever 54 is rotatably journaled on drive shaft 52 by means of openings formed in connection portions 54*a* and 54*b* thereof as shown in FIG. 2. An upwardly projecting finger integrally formed with connection portion 54*b* normally engages with the spring arm of movable contact 20*e* of switch 20 to maintain these contacts normally closed. Arm 54*d* of contact lever 54 engages a reset plate 56 which is non-rotatably mounted on drive shaft 52. Arm 54*e* of contact lever 54 underlies the operating plunger of auxiliary switch 57 to operate this auxiliary switch when the thermal overload relay trips. A yoke portion 54*f* between connecting portions 54*a* and 54*b* has a boss integrally formed thereon for retaining a helical compression spring having its other end retained in a recess in the housing for biasing contact lever 54 in one direction of rotation, that is, its untripped direction.

Trip levers 46, 48 and 50 are alike and trip lever 48 shown in FIG. 4 will be described. This trip lever 48 comprises a lever portion 48*b* and an integral apertured hub portion 48*c* preferably molded of nylon or the like. A metal pawl 48*a* is molded into lever portion 48*b* so that it extends therefrom and engages ratchet wheel 38*b*. A helical tension spring 58 has one end hooked into a hole in the stem of pawl 48*a* and has its other end hooked onto a projection 12*k* in the housing as shown in FIG. 4. Trip levers 46 and 50 are similar and have similar bias springs 60 and 62 hooked between them and like projections in the housing as shown in FIG. 2. As shown in FIG. 4, the aperture in hub portion 48*c* of the trip lever is semi-circular with radially, inwardly extending lug integrally formed therein, that is accommodated in the substantially complimental cross-section of drive shaft 52. The semicircular notch in drive shaft 52 subtends a greater angular arc than does the lug on the trip lever. Thus a lost motion driving connection is provided between each of the trip levers and drive shaft 52 so that any one of the three trip levers may individually trip the thermal overload relay.

As shown in FIG. 2, shaft 52 has non-rotatably mounted at the left end thereof, a generally triangular reset plate 56 having a boss 56*a* formed thereon that engages the lower edge of an indicating plate 64 that cooperates with reset lever 18 as described more fully in the aforementioned U. F. Carter et al. patent. Generally speaking, when the thermal overload relay trips, a projection on indicating lever 64 rises up to window 12*m* in the housing shown in FIG. 3 as an indication that the relay has tripped. When the overload relay is reset by depressing reset lever 18 after the overload has been cleared, indicating plate 64 is moved back down awy from window 12*m*. These movements are controlled by a spring 64*a*, that biases the indicating plate upwardly, and reset plate 56 which is actuated by shaft 52 when the relay trips. Reset lever 18 is biased upwardly by a helical compression spring 18*a* shown in FIG. 2.

As viewed in FIG. 4, springs 58, 60 and 62 tend to rotate their respectively associated trip levers clockwise on drive shaft 52. In their normal state or untripped condition, the pawls of the trip levers, such as pawl 48*a* in FIG. 4 engage the teeth of the ratchet wheels of thermal elements 32 and 36 as well as ratchet wheel portion 38*b* as shown in FIG. 4 and are thus restrained against rotation on shaft 52. Shaft 52 is rotationally held in engagement at its semicircular notch with the lugs in the hub portions of the trip levers by reset plate 56 which is held in its position by engagement of its boss 56*a* with the edge of indicating plate 64. The latter plate is held in its non-indicating position due to the counter-clockwise bias imparted thereto by spring 64*a*.

Figure 5:
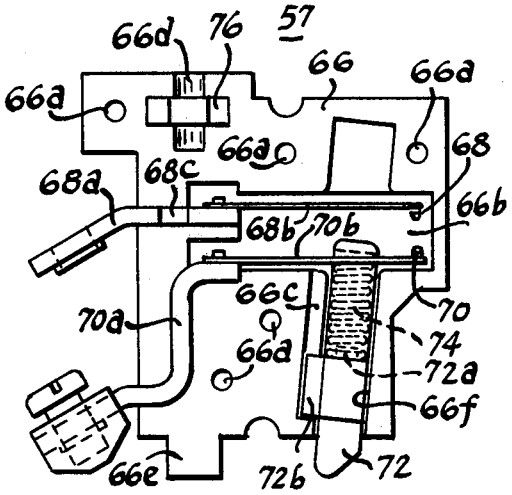
FIG. 5 is a center cross-sectional view of an auxiliary contact unit of the normally open type.
Figure 6:
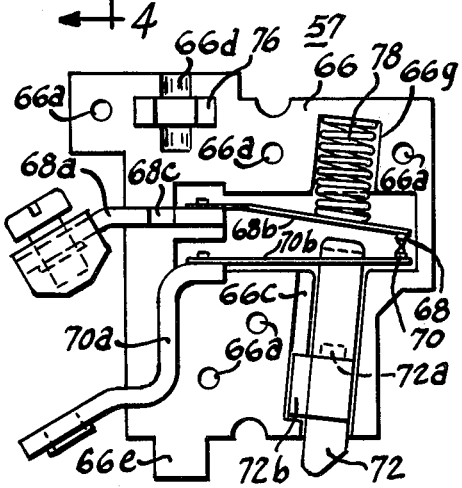
FIG. 6 is a center cross-sectional view of an auxiliary contact unit for the normally closed type.
Figure 7:
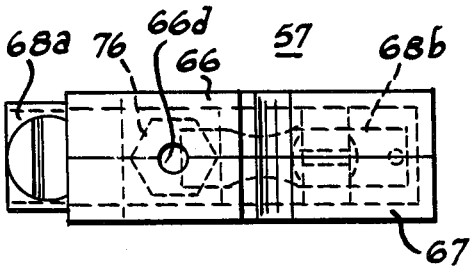
FIG. 7 is a top view of the auxiliary contact unit of FIGS. 5 and 6.

Referring to FIGS. 5 and 6, there are shown two different types of auxiliary contact units, the unit shown in FIG. 5 being a normally open contact unit and the unit shown in FIG. 6 being a normally closed contact unit. FIG. 7 shows a top view of such auxiliary contact unit. As shown in FIG. 5, this auxiliary contact unit is provided with an enclosure comprising two insulating molded housing valves, the left housing half 66 being shown in FIG. 5 and the right housing half 67 being symmetrical or a mirror image of and secured to the left housing half by sonic welding as shown in FIG. 7. For this purpose, the left housing half 66 is provided with a plurality of counter-bored blind holes 66*a* whereas the right housing half is provided with a corresponding plurality of pointed projections of slightly larger diameter than the minor-diamter of the counter-bored holes so that when the two halves are pinched together in interfitting relationship there will be some interference between the diameters of the projections and the side walls of the holes for sonic welding purposes. These housing halves are provided with a recess or switch compartment 66*b* complimentary to one another to provide space for the stationary and movable contacts 68 and 70. The contact operating plunger 72 slides in opposed channels 66*f*. The stationary and movable contacts are secured to terminals 68*a* and 70*a* which extend out through the side of the housing and are locked between the housing halves by lugs 68*a* and notches in the housing halves and the curvature of terminal 70*a*. Plunger 72 has an aperture therein through which movable contact spring 70*b* extends and helical compression spring 74 is situated below movable contact spring 70*b* within that aperture and is held in place by a lug 72*a* at the bottom of the aperture. A key 72*b* integral with plunger 72 slides in keyway 66*c* between the housing halves to keep the plunger correctly oriented during its operation and to limit its outward extension. Stationary and movable contacts 68 and 70 are mounted at the ends of resilient contact springs 68*b* and 70*b*, respectively, to provide for wiping motion between the contacts when they are closed and opened. A nut 76 is recessed between the housing halves at the upper portion thereof and the housing halves are provided with complimentary slots 66*d* above and below the nut, opening to the top of the enclosure, to provide clearance for entry of a mounting screw 77 for securing the auxiliary contact unit onto a notched shelf 12*n* and in a slot 12*p* in the thermal overload relay housing as shown in FIG. 1. A lug 66*e* at the bottom of the housing halves is received in a slot 12*q* in the relay housing to help retain the auxiliary switch unit in its place as shown in FIG. 1.

The normally closed version of auxiliary contact unit shown in FIG. 6 is largely similar to the normally open version in FIG. 5 and like reference characters have been used for like parts. This normally closed version of auxiliary contact unit differs only in that contact operating spring 74 has been removed from the aperture of the plunger and a different contact bias spring 78 has been placed in the blind hole extending from the switch compartment above the movable contact.

The complete auxiliary contact unit is shown in top view in FIG. 7. As shown therein, right housing half 67 has been sonically welded to left housing half 66 which is shown in FIGS. 5 and 6. As shown in broken lines in FIG. 7, the complimentary housing halves 66 and 67 provide the required compartment therein for the contacts and also provide a round opening at the top for entry of the mounting screw into threaded engagement with nut 76.

Referring to FIGS. 5 and 6, it will be apparent that in the normally open version in FIG. 5 contact70 is the movable contact whereas in the normally closed version in FIG. 6, contact 68 is the movable contact. Depressing plunger 72 in FIG. 5 causes this plunger to slide upwardly in its channel in the housing. As a result, operating spring 74 moves contact spring 70*b* upwardly until movable contact 70 engages stationary contact 68. Contact arms 68*b* and 70*b* are resiliant springs so that when the contacts engage, wiping action will take place between the contacts before the plunger reaches the end of its stroke. Also on release of plunger 72, wiping action will take place between the contacts before they separate. This wiping action between the contacts tends to keep the contact surfaces clean and thereby make a good electrical connection.

When plunger 72 in FIG. 6 is depressed it will slide upwardly in its channel while the aperture in this plunger provides clearance for contact arm 70*b* so that this contact arm does not move. Before the end of the plunger stroke, the upper end of the plunger abuts movable contact arm 68*b* and moves it upwardly against the force of bias spring 78 thereby initially causing wiping action between contact 68 and 70 followed by separation of the contacts. When plunger 72 is released allowing it to return downwardly to its normal position, bias spring 78 causes contact arm 68*b* to follow the plunger. Near the end of the plunger return stroke contact 68 engages contact 70 and due to the resiliance of the contact arm springs 68*b* and 70*b*, wiping action takes place between the contacts. At the end of the plunger return stroke, bias spring 78 provides sufficient contact pressure between the contacts for a good electrical connection.

Now let it be assumed that in use an electrical overload condition occurs of such magnitude and duration that one of the thermal elements 32, 34 or 36 is heated sufficiently by its associated heater coil such as 40 so as to melt the solder therewithin sufficiently to release its ratchet wheel. As a result the corresponding tension spring 58, 60 or 62 will pull the pawl such as 48*a* causing rotation of the corresponding trip lever such as 48. As a result, this trip lever will rotate drive shaft 52 a limited amount. The lost motion connection between drive shaft 52 and the other two trip levers will allow drive shaft 52 to rotate a limited amount while these other trip levers remain stationary as they are held by the ratchet wheels of the corresponding thermal elements. Such rotation of the drive shaft will cause corresponding rotation of triangular reset plate 56. The edge of reset plate 56 will engage arm 54*d* of contact operating lever 54 and rotate the latter against the force of its bias spring 55. As a result, finger 54*c* of contact operating lever 54 releases contact spring 20*e* of standard contact subassembly 20 so that these contacts open during the initial part of the rotation of contact operating lever 54. Thereafter, arm 54*e* of contact operating lever 54 begins to depress plunger 72 of auxiliary contact unit 58. Near the end of the rotary movement of contact operating lever 54, arm 54*e* depresses plunger 72 to an extent wherein the contacts of the auxiliary contact unit close if it is a normally open unit or open if it is a normally closed unit. From this it will be apparent that since the closing force of the auxiliary contact unit is required at the end of the tripping stroke and is not required simultaneously with the initial tripping force, there will be a redistribution or retiming of spring forces that will enhance the tripping function with a smaller maximum force requirement. This permits a greater trigger force at the initial trip position. In addition, this auxiliary contact unit is self enclosed and thereby sealed from external dirt and the like and is designed to have contact wipe to provide for improved reliability.

The overload relay may be reset by manual depression of reset button 16 after the overload condition has been cleared and the thermal elements have been allowed to cool so as to allow the eutectic solder to solidify therewithin. When so depressed, the reset lever moves indicating plate 64 downwardly causing it to rotate reset plate 56 back into its original position. Reset plate 56 rotates drive shaft 52 which in its turn rotates trip lever 48 back to its original position so that pawl 48*a* again engages a tooth on the corresponding ratchet wheel of the thermal element coupling. This will cause finger 54*c* of contact operating lever 54 to close standard contact 20*e* and to release plunger 72 of auxiliary contact unit 58. This restores the overload relay to its initial condition so that it can again be tripped by an overload conditon.

While the apparatus hereinbefore described is effectively adapted to fulfill the object stated, it is to be understood that this invention is not intended to be confined to the particular preferred embodiment of thermal overload relay disclosed inasmuch as it is susceptible of various modifications without departing from the scope of the appended claims.

We claim:

1. An overload relay for an electrical power supply circuit comprising in combination;

a relay housing;

a standard switch mounted in said housing and being operable to open in response to an overload current condition to protect said circuit;

a rotatable shaft;

a latched trip lever mounted on said shaft operable upon release to rotate said shaft in a first direction;

means biasing said latched trip lever for rotation in said first direction;

an overload current responsive element having means normally latching said trip lever against rotation and comprising means responsive to an overload current in said circuit for tripping said latch to allow said biasing means to rotate said trip lever and said shaft in said first direction;

a switch operating lever freely rotatably mounted on said shaft and having a finger for operating said standard switch;

means normally biasing said switch operating lever in one rotary direction to cause said finger to hold said standard switch normally closed;

a reset member non-rotatably mounted on said shaft and engaging said switch operating lever to drive the latter in the other rotary direction against the force of its said biasing means when said shaft is rotated in said first direction in response to said overload trip thereby to release said standard switch to allow it to reopen;

a slot in said housing for receiving an auxiliary switch;

an auxiliary switch insertable into said slot and removable therefrom without disassembling said relay;

means to mount said auxiliary switch in said housing slot;

an arm on said switch operating lever for actuating said auxiliary switch at the end of the trip stroke whereby the force required at the beginning of the trip stroke is reduced;

and said auxiliary switch comprising a switch housing enclosing first and second spaced-apart resilient contact strips and a contact actuator, said contact actuator having an aperture through which one of said contact strips extends, and a selected one of two interchangeable contact bias springs, one spring being placed within said aperture below said one contact strip and the bottom of said aperture to provide a normally open switch, and the other spring being alternatively placed between the other contact strip and said switch housing in compression to provide a normally closed switch, and contacts at corresponding ends of said contacts strips being subjected to wiping action upon closing and opening when said contact actuator is actuated by said arm;

and means for resetting said relay.

2. The overload relay for an electrical power supply circuit claimed in claim 1, wherein said means for resetting said relay comprises:

reset means including a reset button externally accessible and operable after said overload condition has cleared to rotate said reset number and said shaft therewith in the opposite direction to release said switch operating lever so as to allow its said biasing means to return it to its original position wherein it restores said auxiliary switch and said standard switch to their normal states.

3. The overload relay for an electrical power supply circuit claimed in claim 2, wherein said reset means comprises;

a reset lever extending from said button into a slot in said relay housing for sliding movement therein;

an indicator plate within said slot;

means on said reset member for moving said indicator plate when said shaft rotates it in said first direction;

and means operable to couple said indicator plate ot said reset lever when said indicator plate is moved as aforesaid so that when said reset button is operated it acts through said reset lever and said indicator plate to rotate said reset member and said shaft in said opposite direction.

4. The overload relay for an electrical power supply circuit claimed in claim 1, wherein:

said switch housing comprises a pair of symmetrical insulating housin halves sealingly secured together to provide a switch compartment therewithin;

and said resilient contact strips have terminal members locked between said housing halves and extending to the exterior thereof for connection to a circuit.

5. The overload relay for an electrical power supply circuit claimed in claim 4, wherein:

said contact actuator is an elongated plunger with one end projecting from said switch housing;

and said housing halves comprises a pair of opposed channels leading from said switch compartment to the outside for accommodating said plunger for sliding movement.

6. The overload relay for an electrical power supply circuit claimed in claim 5, wherein:

said plunger comprises an integral key;

and said housing halves comprise a keyway partway along said channels allowing sliding movement of said plunger while limiting the projection of said one end thereof from said switch housing.

7. The overload relay for an electrical power supply circuit claimed in claim 4, wherein:

said switch housing comprises a blind hole leading from said switch compartment for retaining said other contact strip bias spring.

8. The overload relay for an electrical power supply circuit claimed in claim 1, wherein:

said means to mount said auxiliary switch in said relay housing slot comprises:

a notched shelf above said relay housing slot;

and a screw extending through the notch in said shelf and threaded into said auxiliary switch to rigidly secure the latter within said relay housing slot.

9. The overload relay for an electrical power supply circuit claimed in claim 8, wherein:

aid means to mount said auxiliary switch in said housing slot further comprises:

a lug on the lower portion of said auxiliary switch housing;

and a complementary front-opening notch in said relay housing for accommodating said lug.

10. The overload relay for an electrical power supply circuit claimed in claim 9, wherein:

said switch housing comprises a nut recessed between said housing halves and a clearance hole between said housing halves providing access to said nut;

and said screw being threaded into said nut to clamp said auxiliary switch to said relay housing.

* * * * *